United States Patent [19]

Bernadiner et al.

[11] Patent Number: 5,008,098

[45] Date of Patent: Apr. 16, 1991

[54] METHOD OF COMBUSTION NEUTRALIZATION OF LIQUID WASTE PRODUCTS

[76] Inventors: Mikhail Bernadiner, ulitsa Bakuleva, 12, kv. 24; Vladimir V. Zhizhin, ulitsa Pervomaiskaya, 10, korpus 1, kv. 30, both of Moscow, U.S.S.R.

[21] Appl. No.: 228,755

[22] PCT Filed: Jun. 19, 1987

[86] PCT No.: PCT/SU87/00073

§ 371 Date: Mar. 1, 1988

§ 102(e) Date: Mar. 1, 1988

[87] PCT Pub. No.: WO88/00671

PCT Pub. Date: Jan. 28, 1988

[30] Foreign Application Priority Data

Jul. 14, 1986 [SU] U.S.S.R. ..... 4080495

[51] Int. Cl.[5] ..... F23C 5/00; F27B 3/22; C01B 7/00; F23G 7/00

[52] U.S. Cl. ..... 423/659; 423/240; 423/488; 423/DIG. 20; 431/8; 432/22; 110/238; 110/260; 110/305; 110/345

[58] Field of Search ..... 423/481, 488, 659, 245.3, 423/240, DIG. 20; 431/8; 432/22; 110/238, 260, 305, 345

[56] References Cited

U.S. PATENT DOCUMENTS

| | | | |
|---|---|---|---|
| 4,073,871 | 2/1978 | Opitz et al. | 423/481 |
| 4,198,384 | 4/1980 | Robinson | 423/240 |
| 4,628,835 | 12/1986 | Wollner | 110/238 |
| 4,631,183 | 12/1986 | Lalancette et al. | 423/245.3 |
| 4,644,877 | 2/1987 | Barton et al. | 110/250 |

FOREIGN PATENT DOCUMENTS

| | | | |
|---|---|---|---|
| 502180 | 7/1976 | U.S.S.R. . | |
| 654831 | 5/1979 | U.S.S.R. | 423/659 |
| 1101623 | 7/1984 | U.S.S.R. . | |
| 1350727 | 4/1974 | United Kingdom | 423/240 R |

OTHER PUBLICATIONS

Obzornaya Informatsia Nauchno-Issledovatelskogo Instituta Tekhniko-Ekonomicheskikh Issledovany Niitekhim, 1977.

*Primary Examiner*—Gary P. Straub
*Attorney, Agent, or Firm*—Ladas & Parry

[57] ABSTRACT

The present invention relates to neutralization of liquid waste products containing different organohalides. A method of combustion neutralization of liquid waste products resides in that a mixture of the liquid waste products with an alkali reagent is prepared and introduced in the form of a sprayed flow into a high-temperature stream of the fuel combustion products, sprayed water being introduced between the stream of fuel combustion products and the path of the sprayed mixture. The consumption during combustion neutralization is no less than 1.2 kg per kg of the above mixture of waste products with the alkali reagent and no more than 2.5 kg per kg of the fuel being used.

8 Claims, No Drawings

METHOD OF COMBUSTION NEUTRALIZATION OF LIQUID WASTE PRODUCTS

FIELD OF THE ART

The present invention relates to combustion neutralization of liquid waste products.

PRIOR ART

Known in the art are different methods of combustion neutralization of liquid waste products containing organo-halide compounds including polychlorinated biphenyls, said methods being realized at sea on specially equipped vessels or in furnaces for combustion of industrial waste products. Neutralization is performed by spraying liquid products into a high-temperature stream of fuel combustion products or by burning waste products if they possess high combustibility. A high-temperature treatment of sprayed waste products results in the evaporation of their water fraction and in oxidation of the organic phase with the formation of predomonantly gaseous products, namely, $CO_2$ and $H_2O$. Chlorine present in the waste products being neutralized transforms into HCl and $Cl_2$ at high temperature which causes contamination of the atmosphere or water area (see the abstract journal "Khimia", No. 24, 1985, VINITI, Moscow, Firnheaber Rolf Bodo, "Verbrennung auf hoher See", p. 253–256, abstract No. 24U917 "Umwelt", 1985, No. 3, and the abstract journal "Khimia" No. 19, 1980, VINITI, Moscow, Grayson J. "Incineration burns away waste disposal problems", abstract No. 19U657, Process Eng., 1980.

The known method of combustion neutralization of halide-containing liquid waste products is disadvantageous in that secondary toxic gaseous compounds HCl and $Cl_2$ are discharged into the atmosphere with exhaust gases, an additional purification being required for neutralization of said secondary toxic compounds with the use of complex refineries.

At present for combustion neutralization of halide-containing liquid waste products use is made of the method including preparation of a mixture of the above waste products with an alkali reagent, subsequent introduction of the mixture in the form of a spray into a high-temperature stream of the fuel combustion products, and removal of the exhaust gases (SU, A, 1101623).

To realize the above method use is made of a disintegrator in which mixing of liquid waste products with an alkali reagent is performed, said alkali reagent being taken in 10–30% excess over the stoichiometric amount required for the formation of the corresponding salts (for instance, NaCl, $CaCl_2$).

Besides, a furnace is used into which a fuel-air mixture is fed.

Combustion of the fuel results in the formation of a combustion product stream having a temperature of 1400°–1700° C. The mixture obtained in the disintegrator is introduced into the above flow. When sprayed drops of the mixture of waste products with the alkali reagent contact high-temperature products of fuel combustion, the water fraction of the waste products evaporates, the organic fraction of the waste products decomposes and oxidizes to nontoxic gaseous compounds, namely, $CO_2$, $H_2O$, and $N_2$, and halogens pass into neutral salts due to the above mixing of liquid waste products with the alkali reagent.

The above method is essentially disadvantageous in that the exhaust gases entrap high-toxic organohalide compounds, for instance, polychlorinated dibenzofurans and dibenzidioxines, which is observed upon combustion neutralization of waste products containing high-molecular polycyclic aromatic halocarbons. Although concentration of organohalide compounds in the exhaust gases is insignificant, the presence of organohalide compounds in the atmosphere is impermissible since maximum allowable concentration of the above compounds is extremely low.

The discharge of toxic organohalides in the course of realization of the known method is caused by a partial pyrolysis of the initial compounds contained in liquid products during thermal treatment and by an incomplete decomposition of organohalides.

In addition, molecular (free) halogen formed together with gaseous acids in chemical reactions which proceed in a high-temperature zone of the flow of the fuel combustion products undergoes only incomplete transformation into acid due to an excess amount of the oxidizer in the fuel combustion products. This is caused by the direct contact of the high-temperature products of complete combustion of the fuel with a spreyed flow of the mixture of the liquid waste products with the alkali reagent.

It is an object of the invention to provide a method of combustion neutralization of liquid waste products containing organohalides which will ensure a high sanitary efficiency of this process.

DISCLOSURE OF THE INVENTION

The present invention is directed to the provision of such a method of combustion neutralization of liquid waste products containing organohalides and modifications in the performing of separate stages thereof, which will ensure a high sanitary efficiency of the process.

Said object is accomplished in a method of combustion neutralization of liquid waste products containing organohalides, said method including the treating above waste products with an alkali reagent, the introduction of the resulting mixture in the form a spray into a high-temperature stream of the fuel combustion products, and the subsequent removal of the exhaust gases. According to the invention, a sprayed water flow is introduced between the stream of the fuel combustion products and the sprayed mixture, the consumption of water being no less than 1.2 kg per kg of the mixture of the waste products with the alkali reagent and no more than 2.5 kg per kg of the fuel being used.

The proposed invention makes possible a complete neutralization of liquid waste products containing organohalides without a discharge of toxic compounds into atmosphere with the exhaust gases, not using additional refinery and recovery facilities.

For a more effective burning out of organohalides contained in liquid products, it is expedient, according to the invention, to use a swirly flow of the fuel combustion products, the sprayed flow of the above mixture being introduced into the centre of the swirly flow.

For a better understanding of other objects and advantages of the present invention, a detailed description of the method of combustion neutralization of liquid waste products containing organohalides and specific examples of realizing the method are given hereinbelow by way of illustration.

BEST WAY OF CARRYING THE INVENTION INTO EFFECT

According to the present invention, liquid waste products containing organohalides, for instance, chlorobenzene, carbon tetrachloride, methylchloroform, polychlorinated biphenyls, are subjected to almost a complete combustion neutralization.

Said liquid waste products are mixed (for instance, in a disintegrator) with an alkali reagent, namely sodium or calcium hydroxide, in amounts ensuring 10–30% excess of the alkali reagent over the stoichiometric amount required for the formation of the corresponding salts (NaCl and $CaCl_2$) in the course of mixing.

The obtained mixture is introduced in the form of spray into a furnace. A fuel-air mixture (natural gas, mazut) is fed in a preliminary step into the same furnace to produce high-temperature (1600°–1800° C.) combustion products from the fuel burning and to establish a directed stream. The above spray of the mixture of liquid waste products and the alkali reagent is introduced into the directed stream.

It is expedient to introduce the mixture into the center of the swirly flow of the fuel combustion products in order to ensure the most effective heat- and mass-exchange of the fuel combustion products with the mixture of liquid waste products with the alkali agent, thereby favouring a more complete oxidation of organohalides contained in liquid waste products. To obtain such a swirly flow, the fuel is supplied to the furnace (expediently, of the cyclone type) tangentially.

According to the proposed invention, a sprayed water flow is introduced into a ring zone located between the stream of the fuel combustion products and the sprayed mixture of liquid waste products and the alkali reagent. According to the invention, the consumption of water introduced into the high-temperature zone of the combustion neutralization is no less than 1.2 kg per kg of said mixture of liquid waste products and the alkali reagent and no more than 2.5 kg per kg of the fuel being used.

The invention provides for the use of waste water of any manufacturing process as the sprayed water flow in case the content of organic matter therein is sufficiently low.

The introduction of the sprayed water flow between the stream of the fuel combustion products and the sprayed mixture of waste products and the alkali reagent makes it possible to accelerate the process of decomposition of organohalides due to intensification of the conversion and gasification processes in a high-speed flow of the steam and gas mixture blowing off the sprayed flow of said mixture. The formation of the steam and gas mixture itself is also characterized by a high intensity due to an effective heat and mass exchange between the swirly high-temperature flow of the fuel combustion products and the sprayed water flow.

Free halogen formed partially in the course of chemical transformations in the high-temperature zone transforms completely into a gaseous acid (for instance, HCl) and then into the corresponding alkali salt (for instance, NaCl) under the conditions attained in the high-temperature steam and gas mixture enriched with water steam and almost completely oxygen-free.

The keeping of water consumption at a level of no less than 1.2 kg per kg of the above mixture of waste products with the alkali reagent is dictated by the necessity of a complete conversion and decomposition of organohalides present in the waste products with the formation of gaseous acids in a gas phase.

The keeping of water consumption at a level of no more than 2.5 kg per kg of the fuel being used is dictated by the necessity of a complete thermal neutralization of all organic impurities in the waste products in the high-temperature zone of the furnace as well as by the conditions of neutralization of organic acids with the alkali reagent in the gas phase with the formation of inorganic salts.

Thus, the introduction into the furnace of three flows mentioned above results in the formation of a swirly flow of a high-temperature steam and gas mixture and in an intense heat and mass exchange with the drops of the mixture of waste products and the alkali reagent. The water phase evaporates and organic compounds are subjected to conversion and gasification with the formation of gaseous acids entering into the reaction with a gaseous alkali reagent. The inorganic salts being formed are removed with the exhaust gases from the furnace for subsequent dry or wet dust catching and utilization.

For a better understanding of the present invention specific examples of realizing thereof are given hereinbelow by way of illustration.

EXAMPLE 1

A mixture of liquid waste products containing chlorobenzene with an alkali reagent is subjected to neutralization, the composition of the mixture being 85 mass % of organic and organochlorine compounds and 15 mass % of NaOH. The chlorine content in the liquid waste products being neutralized is 12%.

Natural gas is tangentially introduced into a furnace of the cyclone type at a flow rate of 62 kg/hr and liquid waste products being neutralized are introduced into the centre of the swirly flow of the natural gas combustion products, said liquid waste products being supplied at a flow rate of 20 kg/hr. The consumption of air supplied to the furnace is 530 $m^3$/hr.

A sprayed water flow is introduced into the ring zone located between the swirly flow of the natural gas combustion products and the sprayed flow of the waste products being neutralized, the consumption of the sprayed water flow being 110 kg/hr (which amounts to 5.5 kg per kg of the mixture of the waste products with the alkali reagent and 1.77 kg per kg of the natural gas).

The temperature of the exhaust gases at the output of the cyclone furnace is 1140° C. Neither hydrogen chloride, nor molecular chlorine, nor organochlorine impurities are detected in the exhaust gases. The products of chemical incomplete burning (CO, $H_2$, $CH_4$, $C_mH_n$) are also completely absent. An analysis of the dust removed shows the presence of NaCl and small amounts of $Na_2CO_3$.

EXAMPLE 2

Liquid waste products containing carbon tetrachloride are subjected to neutralization. The waste products are mixed with an alkali reagent, NaOH, in the ratio ensuring 70 mass % of organic and organochlorine compounds and 30 mass % of NaOH in the mixture being prepared. The total chlorine content in the waste products being neutralized is 24.2 mass %.

Neutralization is performed in a furnace of the cyclone type under the conditions similar to those given in Example 1. The consumption of the mixture of the waste products being neutralized with the alkali reagent is 15 kg/hr, the consumption of natural gas 51 kg/hr, the flow rate of air is 485 $m^3$/hr, and of water 95 kg/hr.

The temperature of the exhaust gases at the output of the cyclone furnace is 1130° C.

An analysis of the exhaust gases shows that they contain neither hydrogen chloride, nor molecular chlorine, nor organochlorine impurities. The products of chemical incomplete burning are absent.

EXAMPLE 3

Liquid waste products mixed with the alkali reagent are subjected to neutralization by following the procedures described in Example 1.

Neutralization is performed under the conditions similar to those in Example 1. The consumption of the mixture of the waste products being neutralized with the alkali reagent is 15 kg/hr, the consumption of the natural gas is 51 kg/hr, the flow rate of air is 485 $m^3$/hr, and the consumption of water is 18 kg/hr.

The temperature of the exhaust gases at the output of the cyclone furnace is 1220° C. An analysis of the exhaust gases shows that neither molecular chlorine nor organochlorine impurities are present in the exhaust gases.

INDUSTRIAL APPLICABILITY

The proposed invention will find application in chemical, machine and radio engineering industries for neutralization of liquid waste products containing different organohalide compounds (trichloroethylene, methylchloroform, methylene chloride, carbon tetrachloride, freon, highly toxic polychlorinated biphenyls).

What is claimed is:

1. In a method of combustion neutralization of liquid waste products containing organohalides, comprising treating said liquid waste products with an alkali reagent, introducing the resulting mixture in the form of a spray along a path into a stream of high-temperature fuel combustion products and subsequently removing the exhaust gases, the improvement which comprises introducing sprayed water between the stream of the combustion products and the path of the sprayed mixture, the sprayed water consumption being no less than 1.2 kg per kg of said mixture of waste products with the alkali reagent and no more than 2.5 kg per kg of the fuel being used.

2. A method as claimed in claim 1, wherein a swirly flow of the stream of fuel combustion products is established, the sprayed mixture being introduced into the center of said swirly flow.

3. A method as claimed in claim 2, wherein the sprayed water flow is introduced into a ring zone located between the swirly flow of the fuel combustion products and the path of the sprayed mixture.

4. A method as claimed in claim 3, wherein consumption of the sprayed water is at a rate of about 110 kg./hr.

5. A method as claimed in claim 3, wherein consumption of the sprayed water is at a rate of about 95 kg./hr.

6. A method as claimed in claim 3, wherein consumption of the sprayed water is at a rate of about 18 kg./hr.

7. A method as claimed in claim 3, wherein the alkali reagent is sodium or calcium hydroxide and is present in said mixture in an amount of about 10–30% in excess of the stoichiometric amount required for the formation of a salt from said reagent.

8. A method as claimed in claim 3, wherein the fuel combustion products into which said mixtures are introduced are heated to a temperature of between about 1600° and 1800° C.

* * * * *